US007771172B2

(12) United States Patent
Wang

(10) Patent No.: US 7,771,172 B2
(45) Date of Patent: Aug. 10, 2010

(54) QUICK ASSEMBLY BLADE FOR A CEILING FAN (4)

(75) Inventor: Cliff Wang, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 556 days.

(21) Appl. No.: 11/832,039

(22) Filed: Aug. 1, 2007

(65) Prior Publication Data

US 2009/0035141 A1 Feb. 5, 2009

(51) Int. Cl.
*F04D 29/34* (2006.01)

(52) U.S. Cl. ..... 416/210 R; 416/207; 416/214 R

(58) Field of Classification Search ..... 416/210 R, 416/204 R, 207, 244 R, 214 R, 220 R; 464/70, 464/71

See application file for complete search history.

(56) References Cited

U.S. PATENT DOCUMENTS

2004/0219023 A1* 11/2004 Bird et al. ..... 416/210 R

2005/0123403 A1* 6/2005 Tai ..... 416/210 R

* cited by examiner

*Primary Examiner*—Edward Look
*Assistant Examiner*—Dwayne J White
(74) *Attorney, Agent, or Firm*—Ming Chow; Sinorica, LLC

(57) ABSTRACT

A quick assembly blade for a ceiling fan includes a blade frame, one stop member, a blade and a press board. The blade frame has a pan-shaped body fixed with three projecting bases protruding upward. The blade and the press board are respectively and correspondingly bored with insert holes and engage holes to be respectively fitted on the projecting bases. The stop member is secured on one of the projecting bases and inserted through a through hole of said blade, having its free end formed with a stop portion received in a receiving hole of said press board and stuck on the inner wall of the receiving hole. When the press board is moved backward horizontally, the blade can be quickly and stably assembled on the blade frame, and the stop member is concealed in the receiving hole not exposed to outside, able to elevate the integral beauty of the ceiling fan.

7 Claims, 5 Drawing Sheets

QUICK ASSEMBLY BLADE FOR A CEILING FAN (4)

BACKGROUND OF THE INVENTION

1. Field of the Invention

This invention relates to a quick assembly blade for a ceiling fan, particularly to one firm in structure, integral in external appearance and able to be assembled quickly and stably.

2. Description of the Prior Art

A conventional way of quickly assembling a blade of a ceiling fan on a blade frame, as disclosed in a U.S. Pat. No. 6,802,694, titled "QUICK ASSEMBLY BLADES FOR CEILING FANS", is to have the engage holes of the blade respectively engaged and secured with the underside of the top end of the studs of the blade frame. Then, the stop member of a stop strip is stopped at the front end of the blade to prevent the blade from being moved horizontally after assembled, thus quickly assembling the blade on the blade frame and avoiding the blade being disengaged from the blade frame. However, only by mutual engagement of the engage holes of the blade and the studs of the blade frame, the structure of their combination is unstable and the blade cannot be firmly secured on the blade frame. In addition, after the blade and the blade frame are assembled together, the stop strip is exposed to the outside of the front end of the blade, spoiling integrity and external appearance of the blade.

SUMMARY OF THE INVENTION

This invention is devised to offer a quick assembly blade for a ceiling fan, which includes a blade frame, at least one stop member, a blade and a press board. The blade frame is formed with a pan-shaped body fixed thereon with three projecting bases. The blade and the press board are respectively and correspondingly bored with insert holes and engage holes to be respectively fitted on the projecting bases of the blade. The stop member is secured on one of the three projecting bases of the blade frame and inserted through a through hole of the blade. The press board is bored with a receiving hole matching with the through hole of the blade for receiving a stop portion of the stop member. When the press board is pushed to move backward horizontally, the blade can be quickly and firmly assembled on the blade frame by means of the engage holes and large-area pressing of the press board. In addition, the stop portion of the stop member is stuck on the inner wall of the receiving hole of the press board to prevent the press board from disengaging and it is hidden in the receiving hole not exposed to outside, able to elevate the integrity and external beauty of the ceiling fan.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
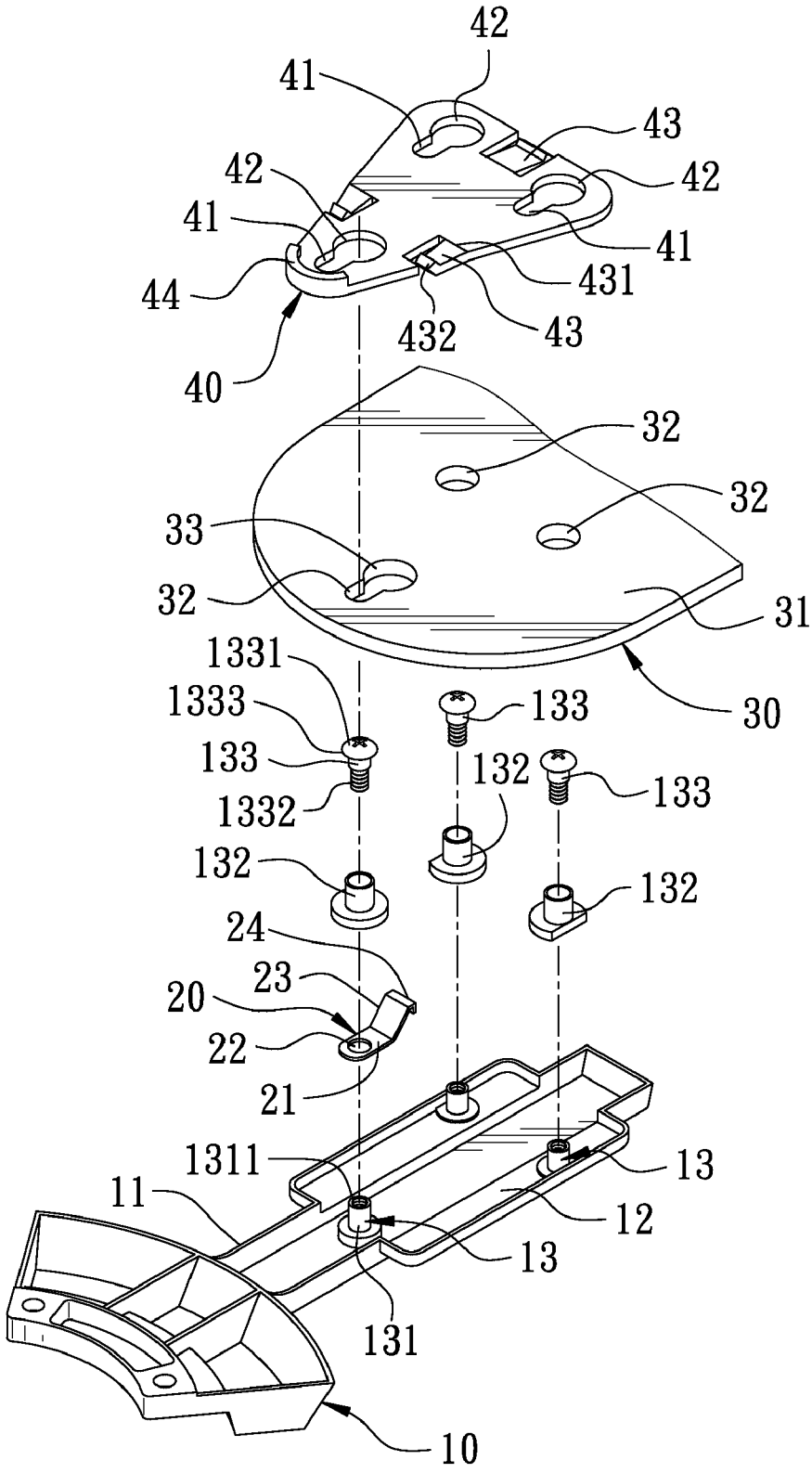
FIG. 1 is an exploded perspective view of a quick assembly blade for a ceiling fan in the present invention.
Figure 2:
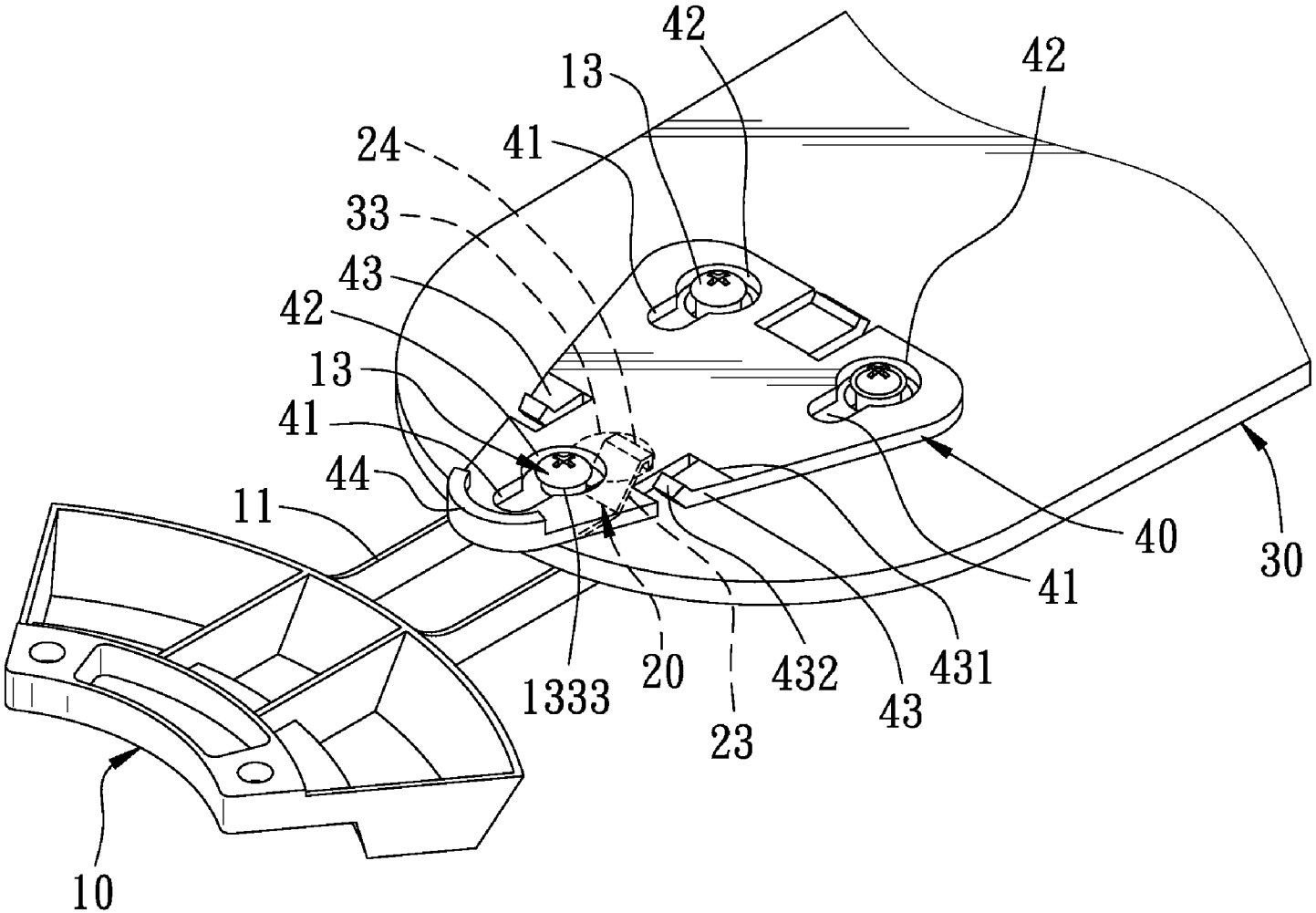
FIG. 2 is a perspective view of the quick assembly blade to be combined together with a press board and a blade frame in the present invention.
Figure 3:
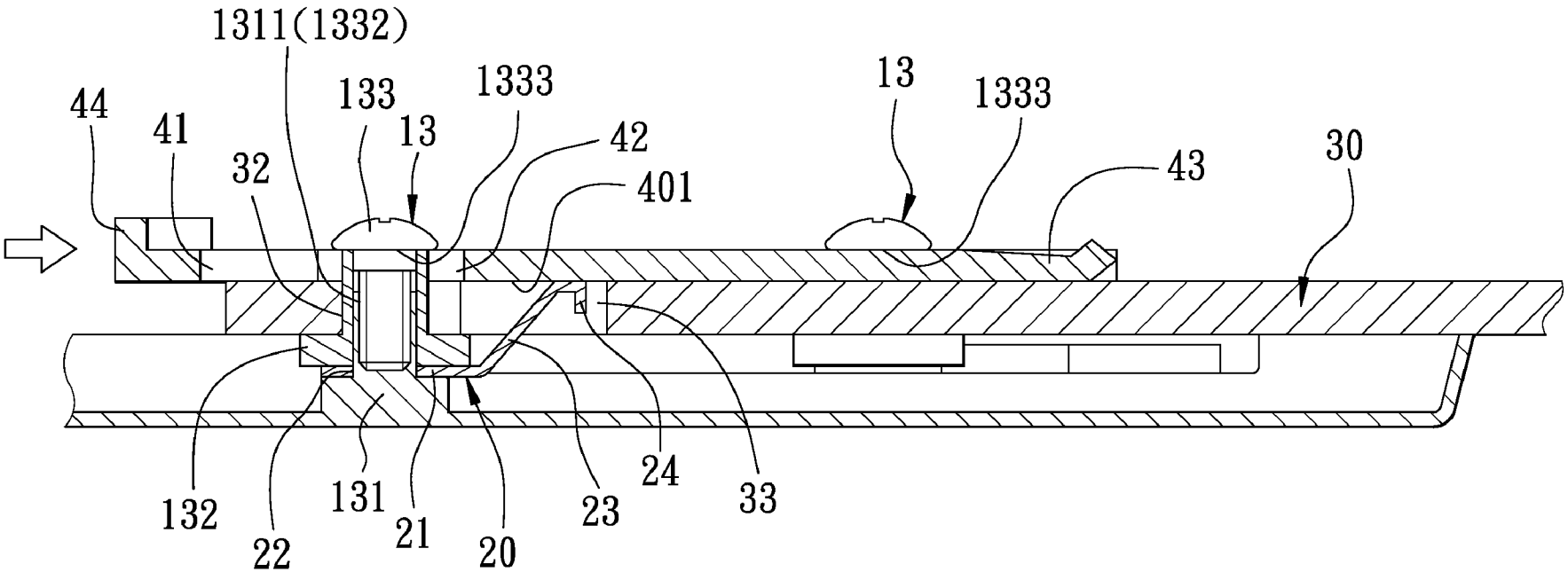
FIG. 3 is a side cross-sectional view of the quick assembly blade to be combined together with the press board and the blade frame in the present invention.

A preferred embodiment of a quick assembly blade for a ceiling fan in the present invention, as shown in FIGS. 1, 2 and 3, includes a blade frame 10, a stop member 20, a blade 30 and a press board 40 combined together.

The blade frame 10 has its rear end extended and formed with a frame work 11 expanding backward to form a pan-shaped body 12 fixed thereon with three projecting bases 13. One of the projecting bases 13 is positioned at the front end of the pan-shaped body 12 and the other two projecting bases 13 are located at the rear end of the pan-shaped body 12, with the three projecting bases 13 spaced apart and arranged into a triangle in position. Each projecting base 113 consists of a stud 131, a bushing 132 and a bolt 133. The stud 131 is integrally formed on the pan-shaped body 11 of the blade frame 10, bored with a threaded hole 1311 in the center; the bushing 132 is a hollow cylinder made of soft plastic to be fitted on the stud 131, and the bolt 133 has its top end formed with a round head 1331 with a comparatively large diameter and its lower end provided with a threaded section 1332 to be screwed in the threaded hole 1311 of the stud 131. The head 1331 of the bolt 133 has its underside formed with an engage portion 1333.

The stop member 20 shaped as an elongate plate has its front end provided with a horizontal fixing strip 21 bored with a through fixing hole 22 to be fitted on the stud 131 at the front end of the pan-shaped body 12 and positioned under the bushing 132. The fixing strip 21 has its rear end bent upward obliquely to form an elastic strip 23 having its free end bent downward to form a stop portion 24.

The blade 30 is a long plate having its front end provided with a combining portion 31 to be assembled on the pan-shaped body 11 of the blade frame 10. The combining portion 31 of the blade 30 is vertically bored with three insert holes 32 to be respectively fitted on the three bushings 132 of the projecting bases 13, with the bushing 132 functioning to fill up the assembly gap of the insert hole 32 for closely combining the insert hole 32 with the stud 131 of the blade 10. Further, the bolt 133 has its engage portion 1333 inserted through the insert hole 32 and positioned over the blade 30. Furthermore, the blade 30 is bored with a through hole 33 corresponding to the location of the stop member 20 and communicating with the insert hole 32 at the front end of the combining portion 31 of the blade 30 for the elastic strip 23 of the stop member 20 to be inserted therethrough, letting the stop portion 24 of the elastic strip 23 positioned above the blade 30.

The press board 40 is a triangular board formed integrally of plastic to be pressed on the combining portion 31 of the blade 30, bored with three through engage holes 41 at the locations corresponding to the three insert holes 32 of the blade 30. The three engage holes 41 have their rear ends respectively expanded to form a receiving hole 42 with a comparatively large diameter and are respectively to be engaged with the engage portion 1333 of the bolt 133 for securing the blade 30 on the blade frame 20, with the stop portion 24 of the stop member 20 positioned in the receiving hole 42 and stuck on the inner wall of the receiving hole 42. Further, the press board 40 has its three edges respectively fixed with an elastic press strip 43 arranged staggering with the three engage holes 41. Each elastic press strip 43 has a connecting edge 431 connected with the press board 40 and a free edge 432 separated from the press board 40, extending downward obliquely from the connecting edge 431 and then bent upward to connect with the free edge 432 and a little protruding out of the underside 401 of press board 40. Furthermore, the press board 40 has the annular edge of its front end formed with a push member 44 for facilitating pushing the press board 40 to move backward horizontally. The press board 40 can also be compression formed of metallic material.

Figure 4:
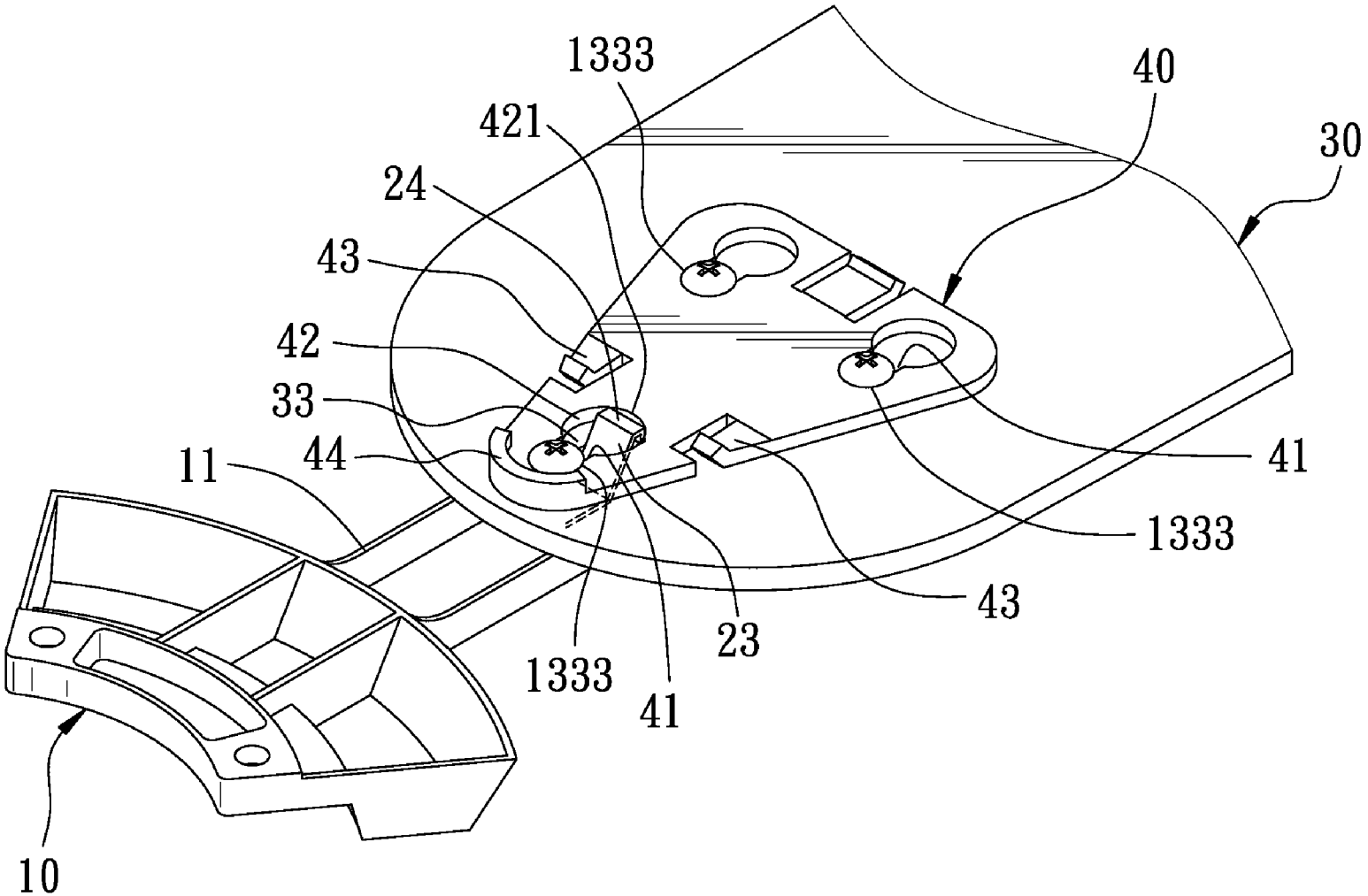
FIG. 4 is a perspective view of the quick assembly blade combined with the press board and the blade frame in the present invention.
Figure 5:
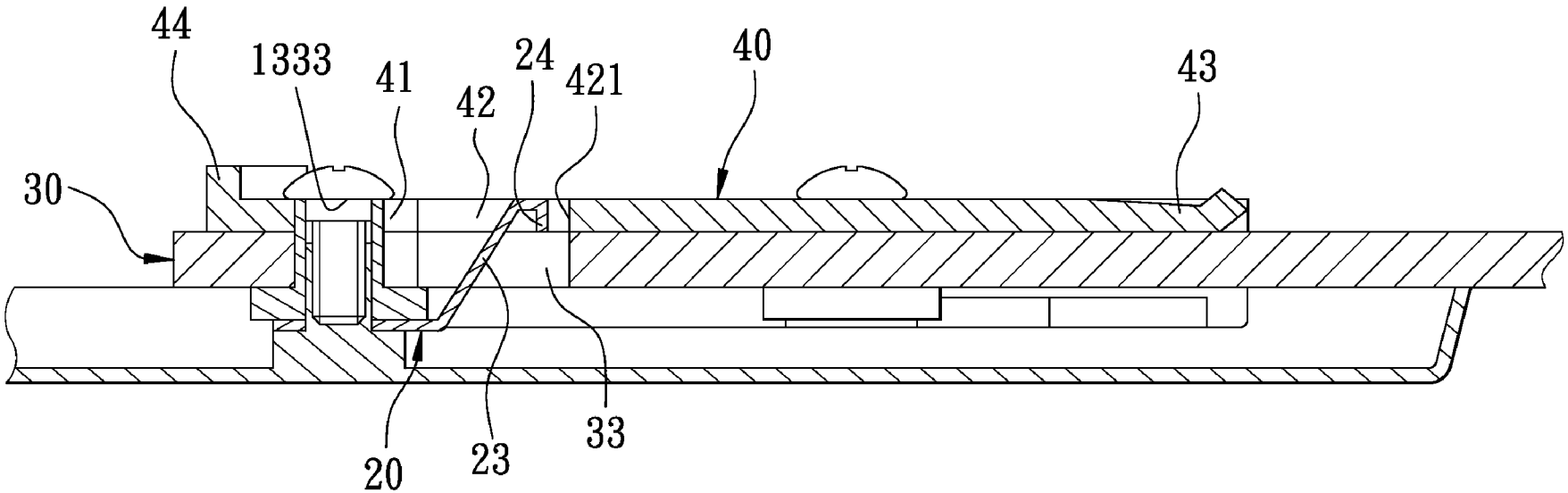
FIG. 5 is a side cross-sectional view of the quick assembly blade combined with the press board and the blade frame in the present invention.

In assembling, as shown in FIG. 2, firstly, the insert holes 32 of the blade 30 are respectively fitted on the projecting bases 13 of the blade frame 10, and then the press board 40 is flatly pressed on the combining portion 31 of the blade 30 and the engage portions 1333 of the bolts 133 of the projecting bases 13 are respectively positioned in the receiving holes 42 of the press board 40. At this time, referring to FIG. 3, the stop portion 24 of the stop member 20 is pressed by the underside 401 of the press board 40 to force the elastic strip 23 to lie in the through hole 33 of the blade 30. Next, the push member 44 of the press board 40 is pushed to force the press board 40 to move horizontally toward the rear end of the blade 30. Thus, referring to FIGS. 4 and 5, after moved backward, the engage holes 41 of the press board 40 will be respectively and fixedly engaged with engage portions 1333 of the projecting bases 13 of the blade frame 10, and the receiving hole 42 of the press board 40 will be located on the through hole 33 of the blade 30. At this time, the stop portion 24 and the elastic strip 23 are released from the pressing force of the press board 40, and the elastic strip 23 will recover to its original state by its own restored elasticity and its stop portion 24 will be actuated to pass the through hole 33 of the blade 30 and stay in the receiving hole 42 of the press board 40 and be stuck on the inner wall 421 of the receiving hole 42 for stopping the press board 40 from disengaging and letting the blade 30 secured between the press board 40 and the blade frame 10, thus finishing assembly of the blade 30. After the blade 30 is assembled, the stop member 20 and its stop portion 24 are concealed in the receiving hole 42 of the press board 40 not exposed to outside, able to elevate integral beauty of the ceiling fan. Moreover, the elastic press strips 43 of the press board 40 are able to produce reverse elastic force to press against the blade 30, able to enhance combination stability of the press board 40 with the blade 30 and the blade frame 10.

By so designing, the blade can be quickly and firmly assembled on the blade frame only by pushing the press board to move backward horizontally for a short distance and by having the stop portion of the stop member stuck on the inner wall of the receiving hole to stop the press board from disengaging. In addition, being pressed and fixed by means of a comparatively large area, the blade can be stably assembled on the blade frame, and the stop member and its stop portion are hidden in the receiving hole of the press board not exposed to outside, able to elevate integrity and outward beauty of the ceiling fan.

While the preferred embodiment of the invention has been described above, it will be recognized and understood that various modifications may be made therein and the appended claims are intended to cover all such modifications that may fall within the spirit and scope of the invention.

I claim:

1. A quick assembly blade for a ceiling fan comprising:

a blade frame having its rear end extended and formed with a framework, said framework having its rear side formed with a pan-shaped body, said pan-shaped body fixed thereon with three projecting bases spaced apart and extending upward, each said projecting base having the underside of its top end formed with an engage portion;

a stop member secured on one of said three projecting bases, said stop member having one side bent and extended upward to form an elastic strip, said elastic strip having its free end formed with a stop portion;

a blade having its front end disposed with a combining portion to be assembled on said pan-shaped body of said blade frame, said combining portion of said blade vertically bored with three insert holes to be respectively fitted on said three projecting bases of said blade frame, said engage portion of said projecting base inserted through said insert hole and positioned over said blade, said blade bored with a through hole at a corresponding location of said stop member, said elastic strip of said stop member inserted through said through hole of said blade to let said stop portion of said stop member positioned over said blade;

a press board pressed on said combining portion of said blade, said press board bored with three engage holes at the locations corresponding to said three insert holes of said blade, each said engage hole having its rear end expanded to form a receiving hole with a comparatively large diameter;

said press board flatly pressed on said combining portion of said blade when said press board is to be assembled on said blade, said stop portion of said stop member pressed to let said elastic strip positioned in said through hole of said blade, and said engage member of said projecting base relatively positioned in said receiving hole of said press board, said engage hole of said press board engaged and secured with said engage portion of said projecting base, and said elastic strip of said stop member engaged in said receiving hole of said press board when said press board is pushed to move backward horizontally to the rear end of said blade, said stop portion of said stop member stuck on the inner wall of said receiving hole for producing effect of stopping;

said press board is a triangular board having its three edges respectively fixed with an elastic press strip positioned staggering with said engage holes;

said elastic press strip being formed with a connecting edge connected with said press board and a free edge separated from said press board;

said elastic press strip being extended downward obliquely from said connecting edge and then bent upward to connect with said free edge;

said elastic press strip being protruded out of the underside of said press board; and said elastic press strip producing reverse elastic force to press against said blade when said elastic press strip is pressed on said blade.

2. The quick assembly blade for a ceiling fan as claimed in claim 1, wherein said three projecting bases of said blade frame are respectively composed of a stud, a bushing and a bolt, said stud formed integrally on said pan-shaped body of said blade frame, spaced apart and arranged into a triangle in position, said stud bored with a threaded hole in the center, said bushing hollow shaped to be fitted on said stud, said bolt having its top end formed with a round head with a comparatively large diameter and its lower end provided with a threaded section to be secured on said stud, said round head of said bolt having its underside formed with an engage portion, said stop member shaped as an elongate plate and having its front end provided with a horizontal fixing strip, said horizontal fixing strip bored with a fixing hole to be fitted on said stud of said blade frame, said horizontal fixing strip having its rear end bent upward obliquely and formed integral with an elastic strip, said elastic strip having its free end bent downward and formed with a stop portion.

3. The quick assembly blade for a ceiling fan as claimed in claim 2, wherein said bushing is made of soft plastic.

4. The quick assembly blade for a ceiling fan as claimed in claim 1, wherein said press board is disposed with a push member protruding upward along the annular edge of its front end.

5. The quick assembly blade for a ceiling fan as claimed in claim 1, wherein said press board has the annular edge of its front end formed with a push member extending upward.

6. The quick assembly blade for a ceiling fan as claimed in claim 1, wherein said press board is compression formed of metallic material.

7. The quick assembly blade for a ceiling fan as claimed in claim 1, wherein said press board is integrally made of plastic.

* * * * *